US006688932B2

(12) United States Patent
Nasu et al.

(10) Patent No.: US 6,688,932 B2
(45) Date of Patent: Feb. 10, 2004

(54) METHOD FOR MANUFACTURING SPARK PLUG AND CAULKING METALLIC MOLD

(75) Inventors: Hiroaki Nasu, Nishikasugai (JP); Wataru Matsutani, Nagoya (JP); Yoshito Uemura, Kagoshima (JP); Makoto Sugimoto, Nagoya (JP); Hirohito Ito, Konan (JP)

(73) Assignee: NGK Spark Plug Co. Ltd., Nagoya (JP)

( * ) Notice: Subject to any disclaimer, the term of this patent is extended or adjusted under 35 U.S.C. 154(b) by 48 days.

(21) Appl. No.: 10/128,437

(22) Filed: Apr. 24, 2002

(65) Prior Publication Data

US 2002/0193033 A1 Dec. 19, 2002

(30) Foreign Application Priority Data

Apr. 27, 2001 (JP) ..... P.2001-131792

(51) Int. Cl.[7] ..... H01T 21/02; H01T 13/20
(52) U.S. Cl. ..... 445/7; 313/141
(58) Field of Search ..... 445/7; 313/141, 313/142, 143

(56) References Cited

U.S. PATENT DOCUMENTS 5,022,881 A * 6/1991 Nagy ..... 445/7
5,556,315 A * 9/1996 Kagawa ..... 445/7
5,831,377 A * 11/1998 Matsubara et al. ..... 313/141
6,130,498 A * 10/2000 Shimizu et al. ..... 313/141
6,589,091 B2 * 7/2003 Harada ..... 445/7

OTHER PUBLICATIONS

Japanese Industrial Standard, "Spark Plugs for Internal Combustion Engines," JIS B 8031, 1995 (Tokyo: Japanese Standards Association, 1995).

* cited by examiner

*Primary Examiner*—Thomas M. Sember
*Assistant Examiner*—Dalei Dong
(74) *Attorney, Agent, or Firm*—Morgan, Lewis & Bockius LLP

(57) ABSTRACT

A method for manufacturing a spark plug, the spark plug includes: a cylindrical metal shell having a portion to be caulked and a tool-engaging portion that is to be attached on an engine; an insulator that is inserted into the metal shell and extends axially; and a caulking metallic mold, the method including caulking the portion to be caulked to be fixed to an outer circumferential face of the insulator with the caulking metallic mold, where in the caulking metallic mold includes a face, the face including a hard carbon film that includes an amorphous carbon phase, and the face is contact with or sliding to the portion to be caulked.

13 Claims, 8 Drawing Sheets

METHOD FOR MANUFACTURING SPARK PLUG AND CAULKING METALLIC MOLD

FIELD OF THE INVENTION

The present invention relates to a method for manufacturing a spark plug and a caulking metallic mold for use with the method.

BACKGROUND OF THE INVENTION

The metal shell of the spark plug is typically composed of iron material such as carbon steel. For the corrosion prevention, a metal plating layer of zinc or nickel is coated on the surface of the metal shell, or a chromate film may be further applied on the surface formed with the metal plating layer. Of these surface treatments, the chromate film containing chromium (VI) (hereinafter referred to as a chromium (VI) film) as chromium constituent has a particularly excellent corrosion resistance, and is suitably employed for the sparkplug. However, the chromium (VI) film contains chromium (VI) as its chromium constituent, and tends to be gradually shunned in these days when there is a rising tide of environmental protection. Therefore, the chromium (VI) film is examined to be done away with in the future.

Thus, the chromate film containing little chromium (VI), namely, the chromate film containing chromium (III) as most of chromium constituent (hereinafter referred to as a chromium (III) film) has been developed from relatively early on. This chromate film can be formed in a treatment bath having a relatively small content of chromium (VI), or may be formed in a treatment bath not containing chromium (VI) at all.

The chromium (III) film as described above was difficult to form in large thickness, and to attain a more excellent anticorrosion than the chromate (VI) film. However, with the development of treatment bath, the thickness of chromate film could be increased, and the excellent anticorrosion obtained. Accordingly, the chromate (III) film tends to be suitably used, with the chromate (VI) film, to prevent corrosion in the metal shell of the spark plug.

Generally, a method for attaching the metal shell of the spark plug to the outside of an insulator inserted inside and having a central electrode disposed at a top end of the metal shell involves caulking and fixing a rear end periphery (portion to be caulked) of the cylindrical metal shell that is curved toward the outer circumferential face of the insulator.

However, if the metal shell having the chromate (III) film formed on its surface is employed, various dimensions of the metal shell often deviate from the tolerance after caulking. The deviation of various dimensions from the tolerance (hereinafter referred to as a dimensional deviation) may be confirmed even when other surface treatment including applying the chromate (VI) film is made on the metal shell, but was especially conspicuous when the chromate (III) film was formed. This dimensional deviation impedes the sufficient effect of caulking. Particularly, if the dimensional deviation of the opposite side of the tool-engaging portion or the caulking height is excessive, the bulk density of talc packed between the inner circumferential face of the metal shell and the insulator or the air-tightness of the spark plug itself is unfavorably decreased. Thus, to suppress this dimensional deviation, the caulking metallic mold useful in caulking and fixing the metal shell to the insulator has a deep compression scroll of the portion to be caulked. By deepening the compression scroll of the portion to be caulked, the opposite side size of the tool-engaging portion is kept from expanding more easily.

SUMMARY OF THE INVENTION

However, the above caulking metallic mold is effective at the early time of use, but less effective as the caulking of the metal shell is repeated, resulting in remarkable dimensional deviation of the metal shell after caulking. This dimensional deviation was especially conspicuous in forming a zinc plating layer as the substrate metal plating layer on the metal shell, and forming the chromate (III) film thereon, but tended to occur when other surface treatments were made.

It is an object of the present invention to provide a method for manufacturing a spark plug and a caulking metallic mold for use with the method in which the deviation of various dimensions of the metal shell after caulking is suppressed within a tolerance even though the metal shell is caulked and fixed repeatedly to the insulator.

To achieve the above object, according to the present invention, there is provided a method for manufacturing a spark plug in which a portion to be caulked of a cylindrical metal shell having a tool-engaging portion to be attached on an engine is caulked and fixed around an outer circumferential face of an insulator extending axially and inserted into the metal shell, characterized in that a caulking metallic mold for caulking and fixing the portion to be caulked is formed with a hard carbon film mainly composed of amorphous carbon phase on a surface contact and sliding with the portion to be caulked of the metal shell.

Further, there is provided a caulking metallic mold for use with the method for manufacturing the spark plug, in which the caulking metallic mold is employed to caulk and fix a portion to be caulked of a cylindrical metal shell having a tool-engaging portion to be attached on an engine around an outer circumferential face of an insulator extending axially and inserted into the metal shell, characterized in that the caulking metallic mold has a hard carbon film mainly composed of amorphous carbon phase formed on a surface contact and/or sliding with the portion to be caulked of the metal shell. The surface contains a first layer containing chromium or titanium and a second layer containing silicon or germanium, and the hard carbon film is formed on the second layer. By forming the hard carbon film on an intermediate layer (the first layer and the second layer) that is a double layer structure, the adhering strength of the hard carbon film to a main body can be heightened, and the hard carbon film can be prevented from peeling in a caulking process for a long period of time. The caulking metallic mold contains the surfaces for contacting and/or sliding on both upper and lower surfaces, and each of the surfaces for contacting and/or sliding can be used to the caulking process if the upper and lower surfaces are turned around. Since the hard carbon film (and the intermediate layer) can be formed on the upper and lower surfaces, a cost is not especially taken for composing such a structure. Accordingly, if the caulking metallic mold is made reversible, a cost-up is not taken for producing the metallic mold, but one metal mold can be used twice by turning it around, and the cost for the metal mold may be saved cheaply.

The deviation of various dimensions of the metal shell after caulking arises because undesired stress is applied on the metal shell at the time of caulking to induce an undesired deformation of the metal shell. To reduce the undesired stress, it is effective to increase the sliding property between a surface of the caulking metallic mold contact and sliding with the metal shell and the metal shell. Thus, the present inventors, as a result of minute examination, have found that if the caulking metallic mold having a hard carbon film mainly composed of amorphous carbon phase made on the surface of the caulking metallic mold contact and sliding with the portion to be caulked of the metal shell is employed, the sliding at the time of caulking is excellently conducted, and the deviation of various dimensions of the metal shell after caulking can be effectively suppressed, and have completed this invention.

As used in this specification, the "hard carbon film mainly composed of amorphous carbon phase" means that the skeleton structure of carbon mainly constituting the film is amorphous, and its Vickers hardness is 1500 kg/mm$^2$ or greater. The preferable range of the thickness of the hard carbon film is 0.6 to 1.2 $\mu$m. If being less than 0.6 $\mu$m, an effect by forming the hard carbon film is less, while being more than 1.2 $\mu$m, an adhering strength of the hard single film itself decreases, and the film is easy to peel. The hardness of film is measured by, for example, a dynamic micro hardness tester. The hard carbon film, including many diamond bonds of carbon in the bond making up the skeleton structure of amorphous carbon, is referred to as a DLC (Diamond Like Carbon) film, with the hardness similar to that of diamond. Therefore, the hard carbon film represented by the DLC film has an especially small friction coefficient, and has the effect of increasing the sliding property with other members. In this invention, the sliding property with the portion to be caulked of the metal shell is increased by forming the hard carbon film mainly composed of amorphous carbon phase represented by this DLC film on the caulking metallic mold. As used in this specification, "chiefly" or "mainly" means involving the greatest content (mass %) in the fabric of interest.

Also, in this invention, the metal shell is plated with zinc or nickel at least on an outer circumferential face of the portion to be caulked, and further treated with chromate on the surface, or only plated with nickel. These surface treatments are typically performed for the metal shell of the spark plug. In this invention, when caulking and fixing the metal shell subjected to the typical surface treatment, the deviation of various dimensions from the tolerance can be suppressed, resulting in significant industrial effect.

The chromate film made on the surface of metal shell may be either chromate (VI) film or chromate (III) film. That is, the deviation of various dimensions of the metal shell in forming the chromate (III) film is especially conspicuous, and owing to the invention, the dimensional deviation can be suppressed effectively. However, when the chromate (VI) film is formed, the invention can be also applied effectively (i.e., the dimensional deviation can be further suppressed). Further, the invention is effective when the metal shell is formed with the chromate film as well as when it is only plated with nickel.

Also, if the conventional caulking metallic mold is employed in forming the metal plating and/or chromate film on the surface of the metal shell, as described above, there was a tendency that the plating defect such flaking or roughness arises more severely with greater use frequency of the caulking metallic mold. However, when the caulking metallic mold of the invention is used, there is the effect that the plating flaking or roughness is less likely to arise as compared with when the conventional caulking metallic mold is used, even if the use frequency of the caulking metallic mold is increased (even if the caulking is repeated many times). Specifically, when the caulking metallic mold of the invention is used, there is no plating defect at the caulked portion of the metal shell, even if used tenfold or more, unlike the conventional caulking metallic mold.

When the metal shell is formed with a chromate film, the chromate film having a film thickness of 0.2 to 0.5 $\mu$m and containing chromium (III) at 95 mass % or more of chromium constituent may be made at least on the outer circumferential face of the portion to be caulked. The chromate film containing chromium (III) at 95 mass % or more of chromium constituent referred to as a chromate (III) film in broad sense) has a content of chromium (VI) of less than 5 mass %, and a significant effect on the environmental measures is expected in employing the chromate film. It is desirable that the chromate film does not contain substantially chromium (VI) in the respect of environmental protection. Since this chromate (III) film involves the especially conspicuous deviation of various dimensions of the metal shell in caulking, as previously described, the effect of the invention can be further expected.

In consideration of the service condition of the spark plug, the film thickness of the chromate (III) film made on the metal shell is preferably set at a value from 0.2 to 0.5 $\mu$m. If the film thickness is above 0.2 $\mu$m, the durability of the chromate (III) film can be fully secured even in the service conditions specific to the spark plug which are subject to the rising temperature and the attack by acid. On one hand, if the film thickness is beyond 0.5 $\mu$m, there occurs a crack on the film in caulking, or an exfoliation of the film, resulting in lower durability. The film thickness of chromate (III) film is preferably set in a range from 0.3 to 0.5 $\mu$m.

However, in the chromate (III) film having the above film thickness, there is a tendency that the deviation of various dimensions especially arises at the time of caulking. This is considered due to the fact that the chromate (III) film is formed through the wet process, the water content in the film is relatively higher, and the water content is excessively distributed particularly on the surface of the chromate film having the film thickness as mentioned above. Namely, due to this water content, an undesirable adsorptive force is exerted on the caulking metallic mold that is slid with the metal shell, impairing the sliding property between them, and causing the dimensional deviation of the metal shell.

With this invention, if the hard carbon film is formed on the caulking metallic mold, the chromate (III) film on the metal shell is prevented from being adsorbed to the caulking metallic mold due to the water content, providing the excellent sliding property. And the deviation of various dimensions in caulking can be suppressed.

When forming the zinc plating layer on the surface of the metal shell, and then forming the chromate (III) film thereon, the dimensional deviation is especially remarkable. This is considered due to the fact that zinc and chromium constituents adhere to the caulking metallic mold by repeating the caulking, hampering the sliding property between the caulking metallic mold and the metal shell. In practice, these adhering constituents are observed on the surface of the caulking metallic mold after use. This invention also exhibits the effect in this situation. This is considered due to the fact that the hard carbon film prevents zinc or chromium from adhering to the caulking metallic mold, maintaining the excellent sliding property with the metal shell.

DESCRIPTION OF REFERENCE NUMERALS AND SIGNS

Figure 1:
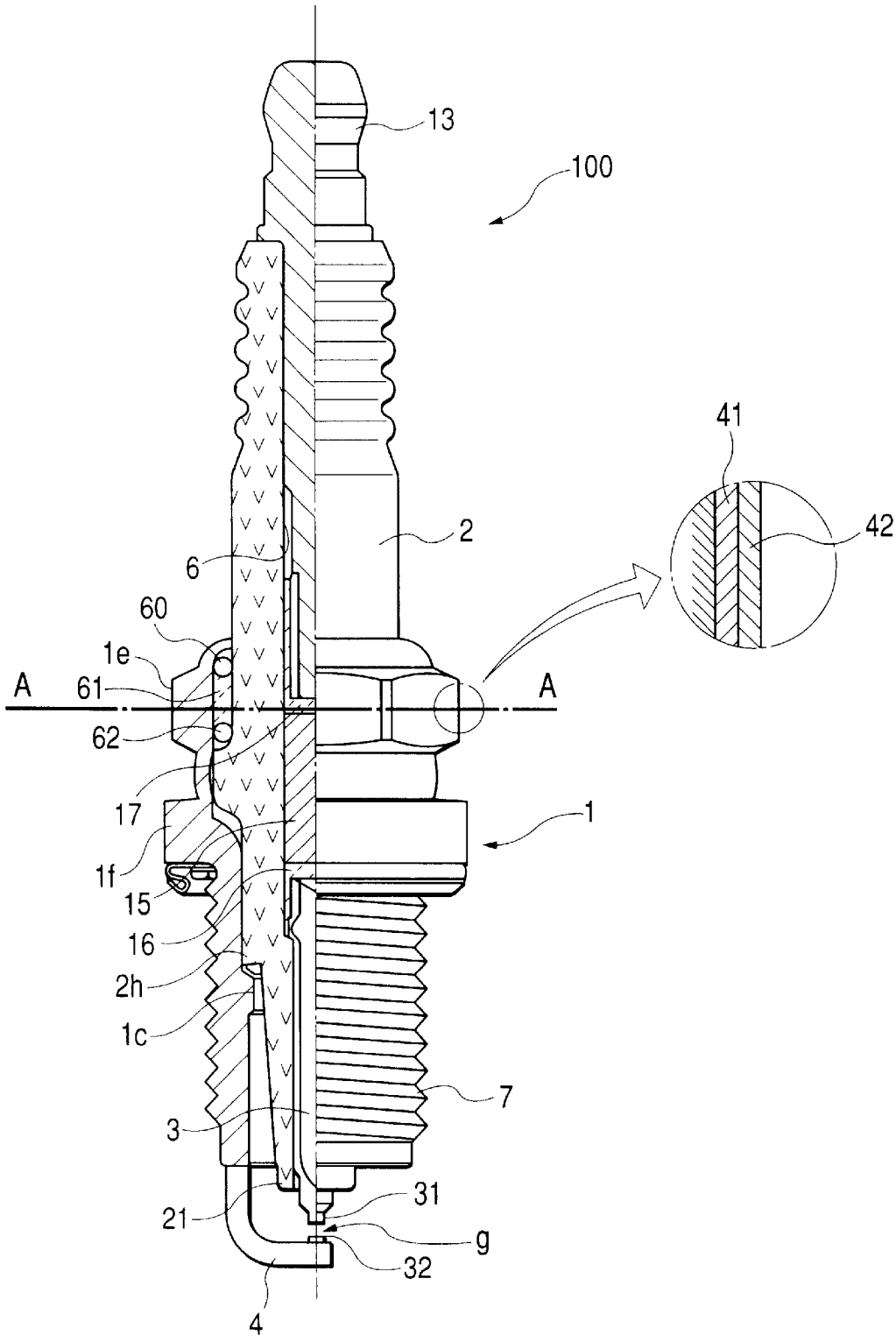
FIG. 1 is a cross-sectional front view of a spark plug according to the present invention.

100 spark plug
1 metal shell
2 insulator
111 caulking metallic mold
111*a* tapering inner circumferential face
111*b* caulking inner circumferential face
111*c* straight portion
R caulking rounded portion
60 hard carbon film
1*e* tool-engaging portion
200 portion to be caulked
200*a* outer circumferential face of portion to be caulked

DETAILED DESCRIPTION OF THE INVENTION

The preferred embodiments of the present invention will be described below with reference to the drawings FIG. 1 shows a spark plug 100 that is manufactured according to the invention. This spark plug 100 comprises a cylindrical metal shell 1, an insulator 2 fitted into the metal shell 1 with its leading end portion 21 protruded therefrom, a central electrode 3 provided inside the insulator 2 with a discharge portion 31 projecting from its top end, and an earth electrode 4 having one end connected with the metal shell 1 and the other end bent sideways to oppose its side face to the discharge portion 31 of the central electrode 3. The earth electrode 4 has a discharge portion 32 formed opposite to the discharge portion 31. A spark discharge gap g is formed in an interstice between the discharge portion 31 and the discharge portion 32. A zinc plating layer 41 and a chromate film layer 42 are formed on the surface of the metal shell 1.

The insulator 2 is composed of a ceramic sintered body such as alumina or aluminum nitride, and has internally a through hole 6 for fitting the central electrode 3 along its axial direction. The metal shell 1 is cylindrically formed of a metal such as low carbon steel, and constitutes a housing for the spark plug 100, with a threaded portion 7 formed around its outside peripheral face to attach the plug 100 to an engine block, not shown. A terminal metal fixture 13 is inserted and secured at one end of the through hole 6, and the central electrode 3 is inserted and secured at the other end. Within this through hole 6, a resistor 15 is placed between the terminal metal fixture 13 and the central electrode 3. Both end parts of this resistor 15 are electrically connected via the conductive glass seal layers 16, 17 to the central electrode 3 and the terminal metal fixture 13, respectively. The discharge portion 32 opposite to the discharge portion 31 may be omitted. In this case, a spark discharge gap g is formed between the discharge portion 31 and the earth electrode 4.

A method for manufacturing the spark plug 100 according to this invention will be described below. First of all, the zinc plating layer 41 as a substrate metal layer is formed on the metal shell 1 through a well-known plating treatment. Other kinds of substrate metal layer may be suitably employed, such as a nickel plating layer. And the metal shell 1 formed with the substrate metal layer is dipped in a chromate treatment bath containing a mixture of chromium (III) salt and a complexing agent for chromium (III) to form the chromate (III) film 42. For higher treatment efficiency, a well-known barrel processing (a processing which is performed while rotating a liquid transparent container in the treatment bath 50 by bulk loading the metal members into the container) can be employed.

As the complexing agents, various sorts of chelating agents (dicarboxylic acid, tricarboxylic acid, hydroxy acid, hydroxyl group dicarboxylic acid or hydroxyl group tricarboxylic acid, for example, oxalic acid, malonic acid, succinic acid, glutaric acid, adipic acid, pimalic acid, cork acid, selenious acid, sebacic acid, maleic acid, phthalic acid, terephthalic acid, tartaric acid, citric acid, malic acid, and ascorbic acid) are effectively employed, but other complexing agents maybe employed. Using this treatment bath, a relatively thick chromate film can be formed. A method of forming the chromate film was disclosed in German Patent DE19638176A1.

It is preferable to set the chromate treatment bath at a temperature from 20 to 80° C. And the dipping time of the subject in the chromate treatment bath is preferably 20 to 80 seconds. If the temperature of the bath is below 20° C., the film thickness of the chromate film can not be obtained sufficiently. On the other hand, if the temperature of the bath is 80° C. or greater, the evaporation of water content from the bath is so vigorous that the bath condition becomes less correct. Also, if the dipping time is below 20 seconds, the sufficient chromate film may not be formed. On the other hand, if the dipping time is beyond 80 seconds, the formed chromate film becomes too thick, causing a crack on the film, or exfoliation of the film.

The metal shell 1 treated with the chromate is rinsed and dried by the hot air.

The insulator 2 having the central electrode 3, the conductive seal layers 16, 17, the resistor 15 and the terminal metal fixture 13 fitted into the through hole 6 is inserted into the metal shell 1 in the above state from the insertion opening side to connect an engagement portion 2*h* of the insulator 2 and an engagement portion 1*c* of the metal shell 1 via a line packing (not shown) (see FIG. 1 for these members). Then, the line packing 62 is disposed inside an insertion opening of the metal shell 1, a packing layer 61 made of talc is formed, and further the line packing 60 is disposed. Thereafter, the portion to be caulked of the metal shell 1 is caulked via these line packings 60, 62 and the packing layer 61 against the insulator 2 to put together the metal shell 1 and the insulator 2.

Figure 2A:
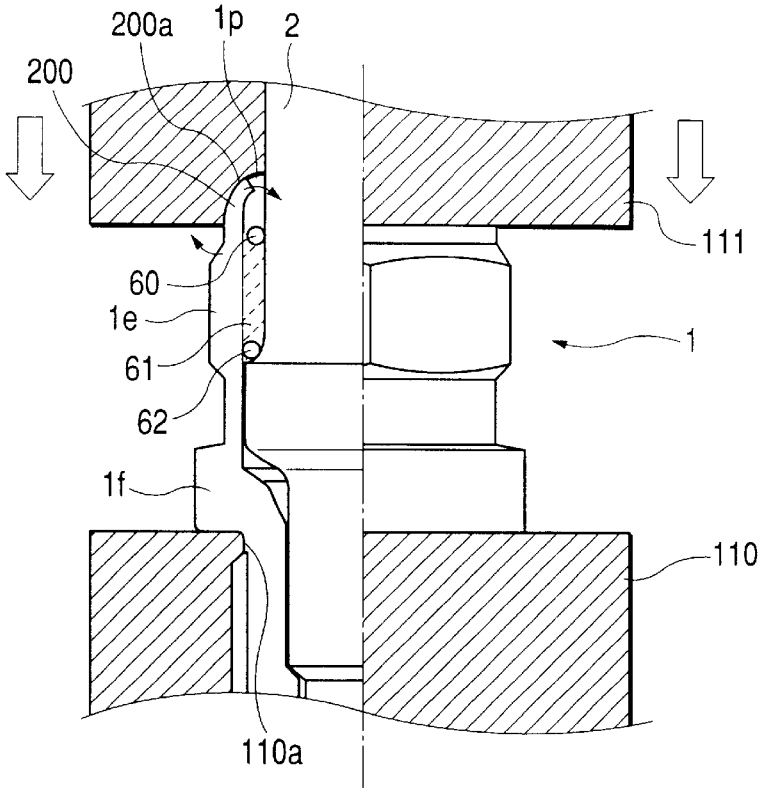
FIG. 2 (FIGS. 2*a*, and 2*b*) is a view for explaining in detail a process of caulking process.
Figure 2B:
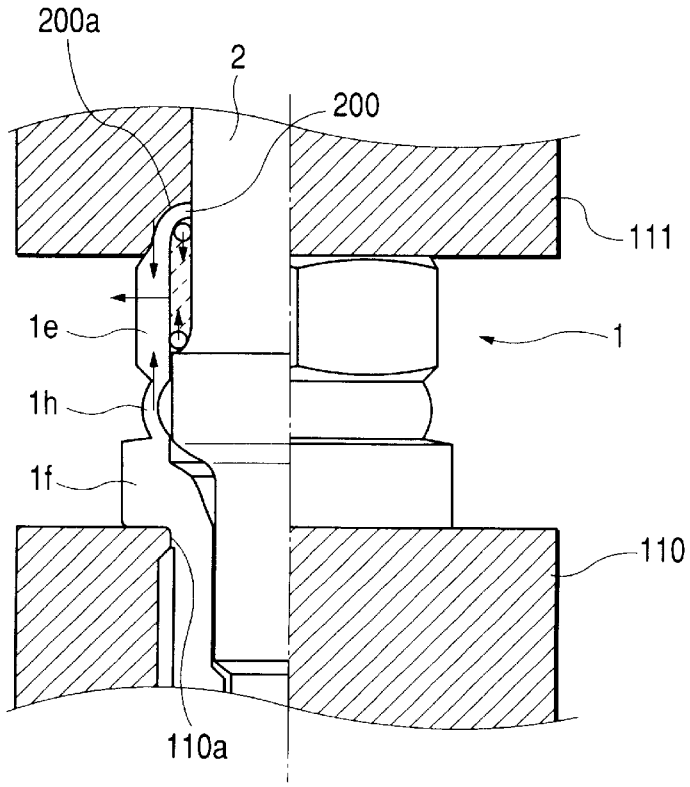

The caulking between the metal shell 1 and the insulator 2 is made specifically in the manner as shown in FIG. 2. First of all, a top end portion of the metal shell 1 is inserted into a set hole 110*a* of a caulking base 110 to support a gas seal portion 1*f* like a flange that is formed on the metal shell 1 around its opening peripheral edge. Then, a caulking metallic mold 111 is placed in contact with the metal shell 1 and held in the axial direction of the metal shell 1. This state is shown in FIG. 2*a*. In its state, if an axial force (see the arrow as indicated in FIG. 2*a*) is applied to the caulking metallic mold 111, there occurs a sliding between a sliding presumed face 200*a* of the portion to be caulked 200 for the metal shell 1 and the caulking metallic mold 111, so that the portion to be caulked 200 of the metal shell 1 is bent toward the insulator 2 to caulk the metal shell 1 and the insulator 2 (FIG. 2*b*). And the insulator 2 is prevented from getting rid of the metal shell 1, and an inner circumferential face of the metal shell 1 and an outer circumferential face of the insulator 2 are sealed. At this time, a buckling portion 1*h* is buckled by axial compression, and a stress is applied on the tool-engaging portion 1*e* to expand its dimension.

Figure 4A:
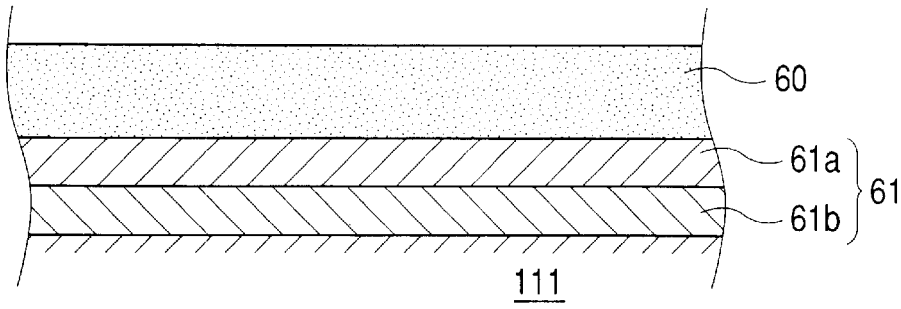
FIG. 4 (FIGS. 4*a*, 4*b* and 4*c*) is a view showing hard carbon films made on the caulking metallic mold.
Figure 4B:
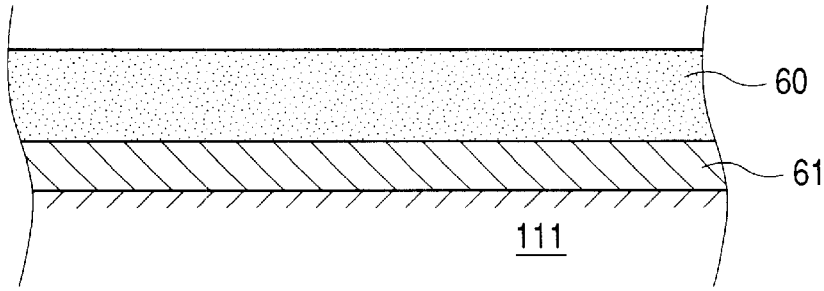
Figure 4C:
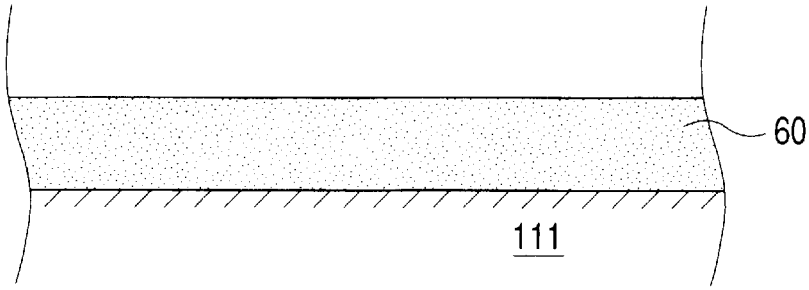

The caulking metallic mold 111 for use with the caulking can be formed with the hard carbon film 60 mainly composed of amorphous carbon layer that is the essence of the invention. To increase the contactness between the caulking metallic mold mostly composed of tool alloy steel and the hard carbon film, an intermediate layer 61 may be formed between the hard carbon film 60 and the caulking metallic mold 111 (FIG. 4*a*). The intermediate layer 61 may be formed only in a single layer as shown in FIG. 4*b*, or in plural layers as shown in FIG. 4*a*. When the intermediate layer 61 is formed in two layers as shown in FIG. 4*a*, it is desirable that an upper intermediate layer 61*a* mainly composed of silicon or germanium is formed on a lower intermediate layer 61*b* mainly composed of chromium or titanium to increase the contactness. In Examples of this specification, the hard carbon film 60 having a thickness of 1 μm is formed on the upper intermediate layer 61*a* composed of silicon having a thickness of 0.25 μm which is formed on the lower intermediate layer 61*b* composed of titanium having a thickness of 0.25 μm. The formation of a multi-layer film structure can be made by the method as disclosed in JP-A-6-60404, for example. It is described in detail in the followings.

First of all, the lower intermediate layer 61*b* and the upper intermediate layer 61*a* are formed in succession by the well-known method of vacuum evaporation, ion plating or sputtering, after the surface of the caulking metallic mold 111 is cleaned. Then, it is set at the cathode in a vacuum chamber of a plasma polymerization film formation apparatus. And the vacuum chamber is evacuated, and a hydrocarbon gas (e.g., methane, ethylene, benzene, hydrogen may be mixed) is introduced through a gas inlet opening, its pressure being adjusted to about 0.1 torr. And a high frequency voltage is applied between cathode and anode within the vacuum chamber to generate a plasma. Thereby, hydrocarbon is decomposed and deposited in the form of amorphous carbon to form the hard carbon film 60 having excellent contactness.

Figure 3:
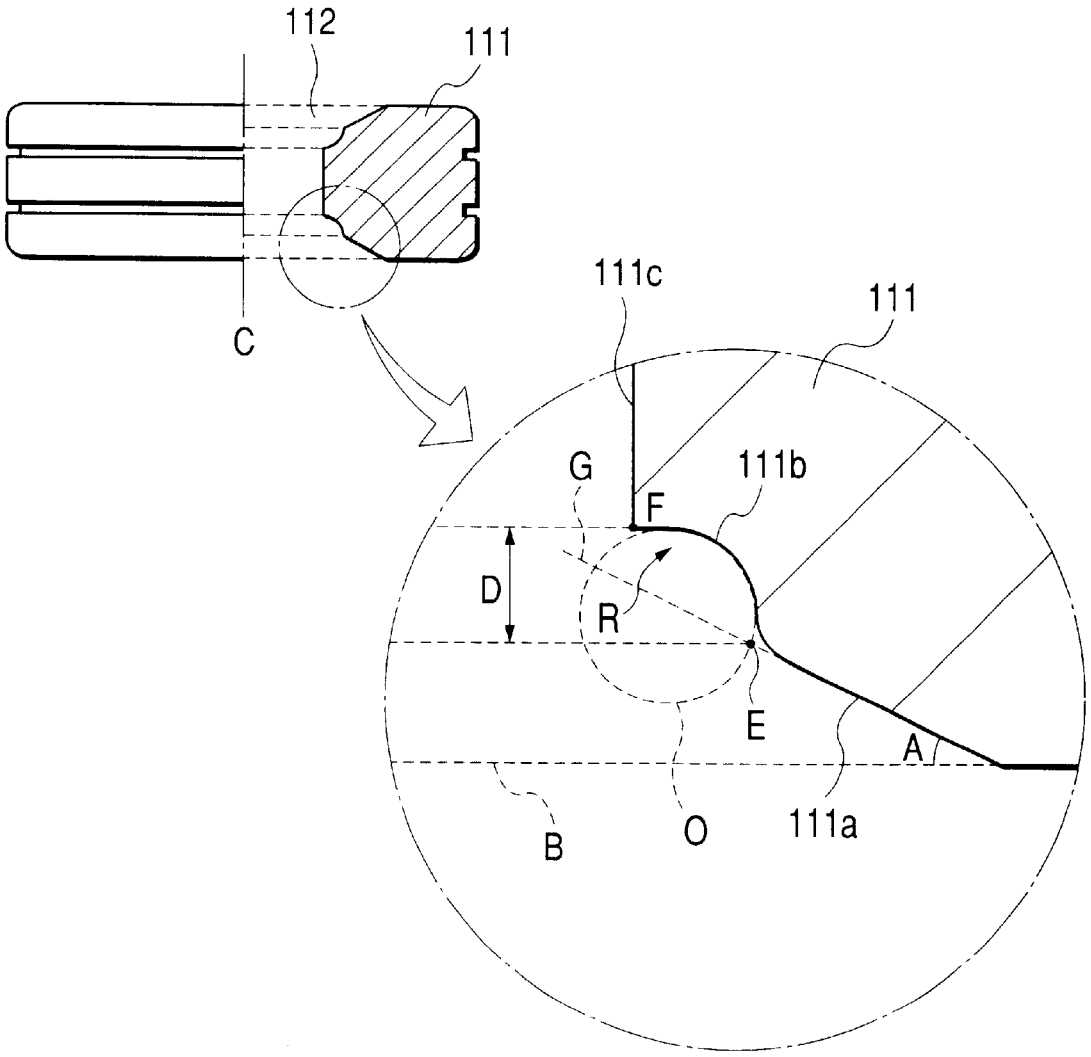
FIG. 3 is a view showing one example a caulking metallic mold to explain the definition of the caulking rounded portion depth D and the mold taper angle A.

FIG. 3 shows one example of the caulking metallic mold 111 according to the invention. The caulking metallic mold 111 of the invention has a through hole 112 in a direction of axis C, and is formed with a tapering inner circumferential face 111*a* on the inner circumferential face at least on one side in the axial direction, and a caulking rounded portion R for bending the portion to be caulked 200 of the metal shell 1. The caulking rounded portion R is formed between the tapering inner circumferential face 111*a* and a straight portion 111*c*. In FIG. 3, to extend the life of the mold, the tapering inner circumferential face 111*a* and the caulking rounded portion R are formed like a ring on both side of the axis C. With such a structure, in case one of the caulking rounded portions R is deformed, or the hard carbon film 60 formed thereon is worn, the metallic mold can be re-used by turning it around. Also, a hard carbon film mainly composed of amorphous carbon phase is formed at least on the caulking inner circumferential face 111*b* of the caulking rounded portion R to increase the sliding property with the metal shell 1 of the spark plug. The caulking inner circumferential face 111*b* for forming this caulking rounded portion R is convexed toward the inside of the caulking metallic mold 111. And the rounded is attached in a convex form on the outside near the boundary between this caulking inner circumferential face 111*b* and the tapering inner circumferential face 111*a*. Herein, the angle of the line B orthogonally crossing the central axis C to the tapering inner circumferential face 111*a* formed in an axial cross section of the caulking metallic mold 111 is defined as a mold taper angle A(°). And the length of the caulking rounded portion R in the direction of axis C is defined as the caulking rounded portion depth D (mm). The length of the caulking rounded portion R in the direction of axis C is defined as the longest distance from a point E to the caulking inner circumferential face 111*b* in the direction of axis C, supposing that the point E is an intersection of a virtual circle O along the caulking inner circumferential face 111*b* of the caulking rounded portion R made by the extension line G of the tapering inner circumferential face 111*a*. The inner diameter of the straight portion 111*c* is larger than the outer diameter of the insulator 2 on the rear side of the portion to be caulked 200 of the metal shell 1, thereby allowing the rear side of the insulator 2 to be inserted.

The caulking metallic mold 111 is suitably employed in accordance with the sort of the spark plug to be produced. That is, there are conditions for the mold taper angle A(°) of the mold and the depth D (mm) of the mold caulking rounded portion R in accordance with the dimension of the spark plug (more particularly, the metal shell) to be produced. That is, the following conditions must be met.

(1) When the opposite side size N (mm) (see FIG. 6) of the tool-engaging portion 1*e* for the metal shell 1 is 14 mm or less (this case may be also denoted as N≦14 mm), $$6 \leqq A/D \leqq 22 \qquad \text{condition 1}$$

(2) When the opposite side size N (mm) of the tool-engaging portion 1*e* for the metal shell 1 is from 15.7 mm to 16 mm, and the screw diameter as specified in JIS-B8031 for the metal shell 1 is 14 mm, 12 mm or 10 mm (this case may be also denoted as N=16 mm), $$5.5 \leqq A/D \leqq 19.5 \qquad \text{condition 2}$$

(3) When the opposite side size N (mm) of the tool-engaging portion 1*e* for the metal shell 1 is from 19.7 mm to 20 mm, and the screw diameter as specified in JIS-B8031 for the metal shell 1 is 14 mm (this case may be also denoted as N=20 mm), $$3 \leqq A/D \leqq 9.5 \qquad \text{condition 3}$$

If the caulking metallic mold 111 is employed meeting any of the conditions, the deviation of various dimensions of the metal shell 1 after caulking the metal shell 2 can be suppressed owing to the effect of forming the hard carbon film 60.

In the above case (1), in addition to the condition 1, when the mold taper angle A is from 15 to 35°, and the mold caulking rounded portion depth D is from 1.6 to 2.4 mm, the deviation of various dimensions of the metal shell 1 can be suppressed. Also, in the above case (2), in addition to the condition 2, when the mold taper angle A is from 15 to 35°, and the mold caulking rounded portion depth D is from 1.8 to 2.6 mm, or in the case (3), in addition to the condition 3, when the mold taper angle A is from 10 to 20°, and the mold caulking rounded portion depth D is from 2.2 to 3 mm, the deviation of various dimensions of the metal shell 1 can be further suppressed.

If the caulking rounded portion depth D (mm) is too great, the portion to be caulked 200 does not sufficiently contact with a desired position of the insulator 2, inducing the deviation of various dimensions of the metal shell 1, and decreasing the air-tightness. If the caulking rounded portion depth D (mm) is too small, the shape of the caulking portion 220 (see FIG. 2*b*) obtained after caulking is unfavorably not excellent, likewise inducing the deviation of various dimensions. Accordingly, the caulking rounded portion depth D (mm) should be set up in the above range, depending on the shape of the spark plug 100 to be produced. Also, if the mold taper angle A (°) is too great, the caulking metallic mold 111 comes into contact with the tool-engaging portion 1*e* too early, exerting an excess stress on the tool-engaging portion 1*e*, and causing the dimensional deviation. On the contrary, if the mold taper angle A (°) is too small, the caulking metallic mold 111 comes into contact with the tool-engaging portion 1*e* too late, causing the dimensional deviation. Accordingly, the mold taper angle A (°) should be set up in accordance with the dimension of the spark plug to be produced.

The caulking of the metal shell 1 to the insulator 2 may be made by hot or cold caulking.

In this embodiment of the invention, the caulking metallic mold 111 is formed with the tapering inner circumferential face 111*a* and the caulking rounded portion R on both sides in the direction of axis C, but the caulking metallic mold 111 may be formed with the tapering inner circumferential face 111*a* and the caulking rounded portion R only on one side in the direction of axis C. In this case, the hard carbon film 60 to increase the sliding property with the metal shell 1 may be formed at least on the caulking inner circumferential face 111*b* of the caulking rounded portion R.

Moreover, in the above embodiment, talc is packed between the outer circumferential face of the insulator 2 and the inner circumferential face of the metal shell 1 for caulking, but the invention is not limited to the above embodiment, and may be naturally applied to the method of manufacturing the spark plug for caulking the metal shell 1 without packing the talc between the inner circumferential face of the metal shell 1 and the outer circumferential face of the insulator 2.

EXAMPLES

The following experiments were practiced to examine the effect of the invention.

Example 1

The following experiment was performed to examine the effect of reducing the dimensional deviation in caulking the metal shell in the case where the DLC film was made on the mold. Firstly, using the cold forging carbon steel wire SWCH8A defined in JIS-G3539, as a raw material, the metal shell 1 of FIG. 1 was produced by cold forging. Then, by making a well-known electrolytic zinc plating treatment using an alkaline cyanide bath, a zinc plating layer having a film thickness of about 5 $\mu$m was formed.

The metal shell 1 formed with a chromate (III) film and a chromate (VI) film by the following method was prepared.

(1) Chromate (III) Film

The chromate treatment bath was constructed by dissolving chromium (III) chloride ($CrCl_3.6H_2O$) of 50 g, cobalt (II) nitrate ($Co(NO_3)_2$) of 3 g, sodium nitrate ($NaNO_3$) of 100 g and malonic acid of 31.2 g per liter of the deionized water, and held at a liquid temperature of 60° C. by a heater, whereby pH of the bath was adjusted at 2.0 by the addition of caustic soda solution. And the metal shell 1 after zinc plating was dipped for 60 seconds in the chromate treating solution, then rinsed, and dried temporarily by the hot air at 70° C. for 180 seconds to form a chromium (III) based chromate film. Thereafter, the chromate film was dried by the hot air. It was confirmed that the 95 mass % of the chrome component contained is chromium (III) by the X-ray photoelectron spectroscopic analysis (XPS). Also, the film thickness of chromate (III) film was actually measured in cross section by SEM and confirmed within a range from 0.2 to 5 $\mu$m.

(2) Colored (Yellow) Chromate Film (Chromate (VI) Film)

A yellow chromate treatment bath was prepared by dissolving chromic acid anhydride 7 g per liter, sulfuric acid 3 g per liter, and nitric acid 3 g per liter in the deionized water, and held at a liquid temperature of 20° C. And the metal shell 1 was dipped for about 15 seconds in the yellow chromate treatment bath, lifted, and dried by the hot air at 70° C. to form a chromate film. Also, the film thickness of chromate film was actually measured in cross section by SEM in the same was as the chromate (III) film, and confirmed within a range from 0.2 to 5 $\mu$m.

For the measurement of the film thickness, a thin film (e.g., Au thin film) of constituent having a higher conductivity than the chromate film is formed on the film surface by sputtering to make the observation of chromate film easier. In an SEM image, the chromate film layer having low conductivity is reflected darkly on the substrate layer (e.g., zing plating layer) and a new thin film layer having high conductivity (Au film layer), whereby the chromate film image can be easily confirmed from its contrast. For example, the white line is drawn corresponding to each boundary between the zinc plating layer and the Au film layer in the SEM image, and the film thickness is identified from the distance between the white lines.

Figure 5:
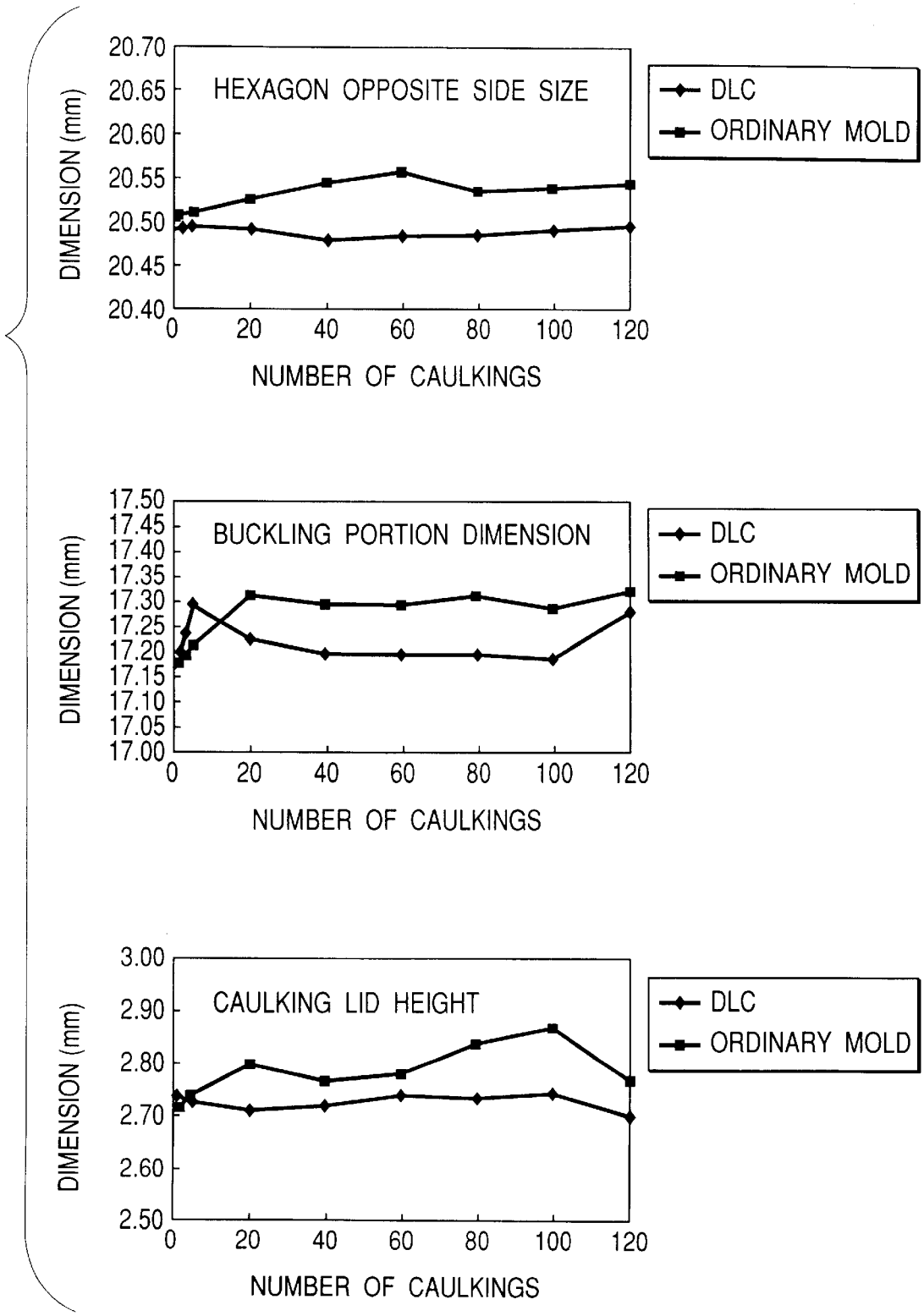
FIG. 5 is a graphical representation showing the relation between the number of caulkings and various dimensions in the example 1.
Figure 6:
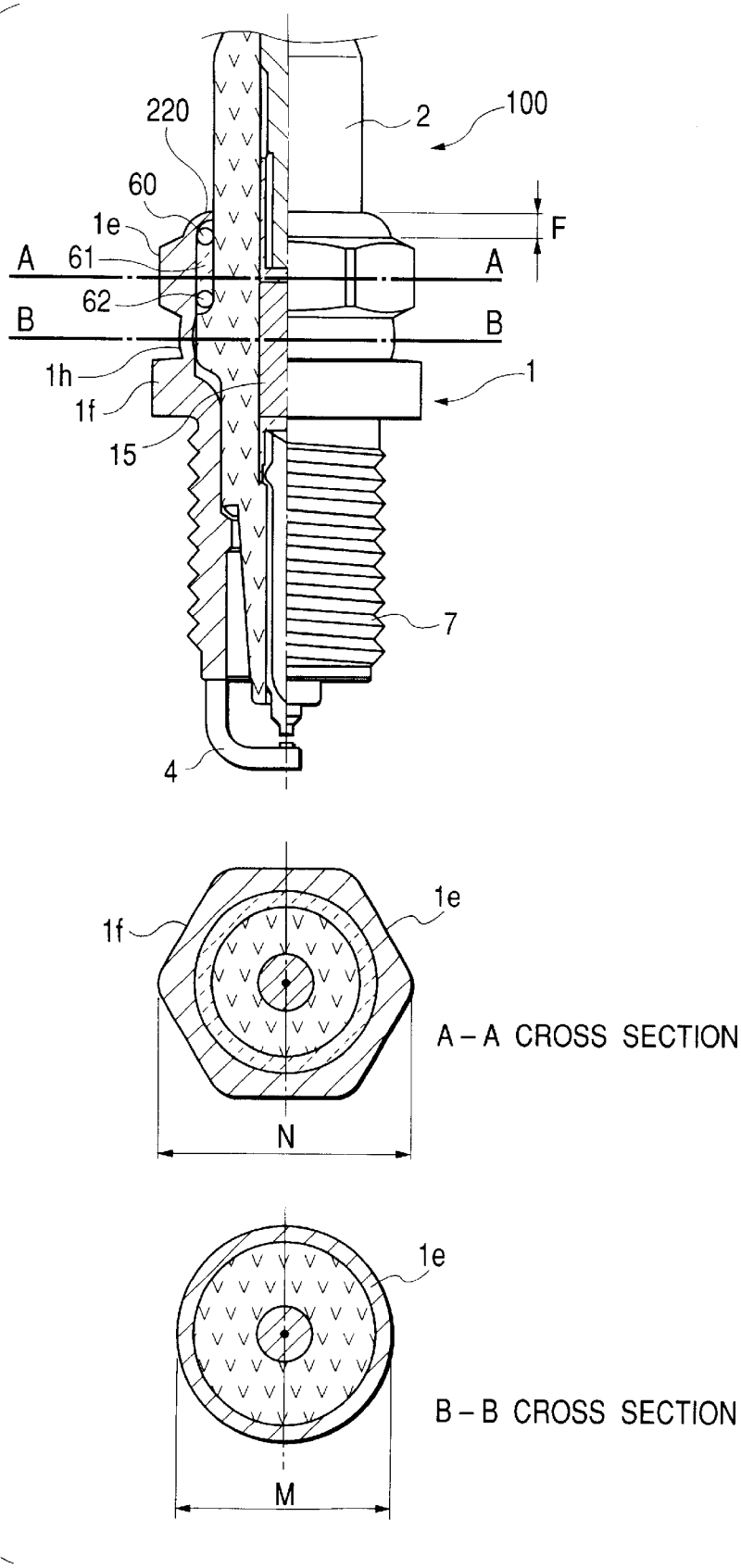
FIG. 6 is a view for explaining the definition for various dimensions of a metal shell.

A plurality of metal shells formed with the chromate (III) film, with the insulator fitted in, were prepared, and the metal shells of the same dimension were caulked in succession by applying the same load thereon, using a mold formed with the DLC film on the surface (hereinafter referred to a DLC mold) or a mold formed with no DLC film (hereinafter referred to an ordinary mold), whereby the number of caulkings and various dimensions of the metal shells after caulking were measured in relation. The DLC film was made on the caulking metallic mold by the plasma polymerization method as previously mentioned. Herein, the source gas was methane, with a gas flow rate of 30 $cm^2$/min., a pressure of 0.1 torr, and a high frequency power of 100W. The Vickers hardness of the DLC film obtained was measured by the dynamic micro hardness tester, and confirmed to be 1500 $kg/mm^2$ or more. The obtained results are shown in FIG. 5. Various dimensions of the metal shell 1 were measured at the positions as indicated in FIG. 6. First of all, the opposite side size N (also called a hexagon opposite side size) of the tool-engaging portion 1*e* as viewed in cross section taken along the line A—A in FIG. 6 means the distance N between two parallel opposite faces of the tool-engaging portion 1*e*. Also, the buckling portion diameter means the diameter M of the visible outline for a buckling portion 1*h* of FIG. 6 as viewed in cross section, when the B—B cross section is taken to make the visible outline the greatest diameter. Further, the caulking lid height F means the axial length of a portion to be caulked 200 that is formed after curvature (i.e., the axial length of a caulking portion 220).

In FIG. 5, the dimensions of the hexagon opposite side length, the buckling portion diameter and the caulking height are greater than at the early time of use in the case of the ordinary mold, every time when the number of caulkings is increased (i.e., at every time of use). In the case of employing the DLC mold, the dimensions are hardly changed as compared with those at the early time of use even though the number of caulkings is increased, in which the increase in each of the dimensions falls within a smaller range than in the case of the ordinary mold. In the manner, it can be found that the deviations of various dimensions for the metal shell are suppressed by using the DLC mold.

Figure 7:
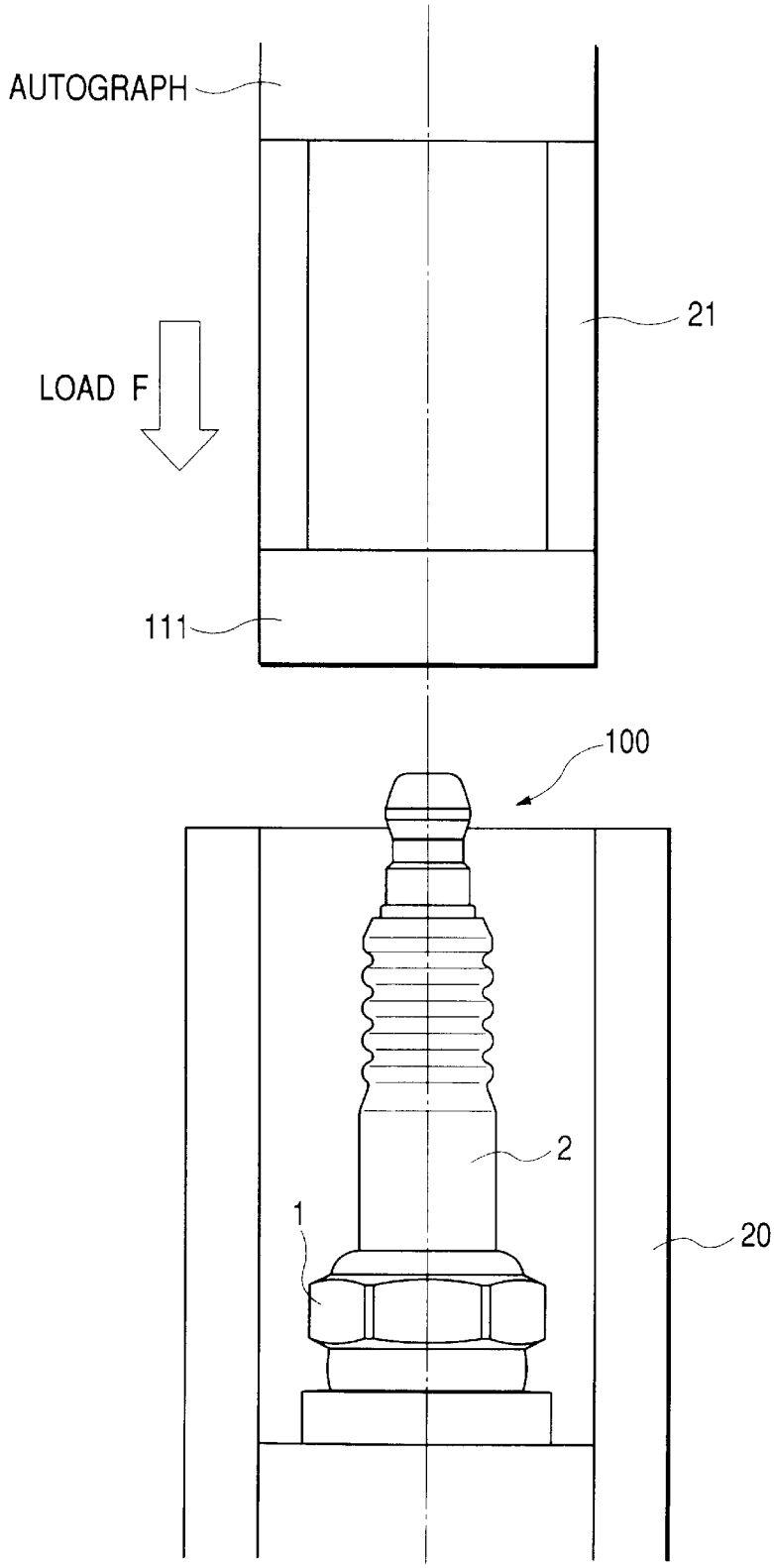
FIG. 7 is a view for explaining a method for measuring the relation between load and displacement in caulking.

Further, the sliding property between the metal shell and the caulking metallic mold was examined by the following method. As shown in FIG. 7, the insulator 2 was inserted into the metal shell 1, and held by a first jig 20. Thereafter, a load F is applied axially via a second jig 21 to the caulking metallic mold 111 by autograph, whereby the relation of load F and the axial displacement x of the caulking metallic mold 111 was measured. The setting conditions of autograph were as follows.

Figure 8:
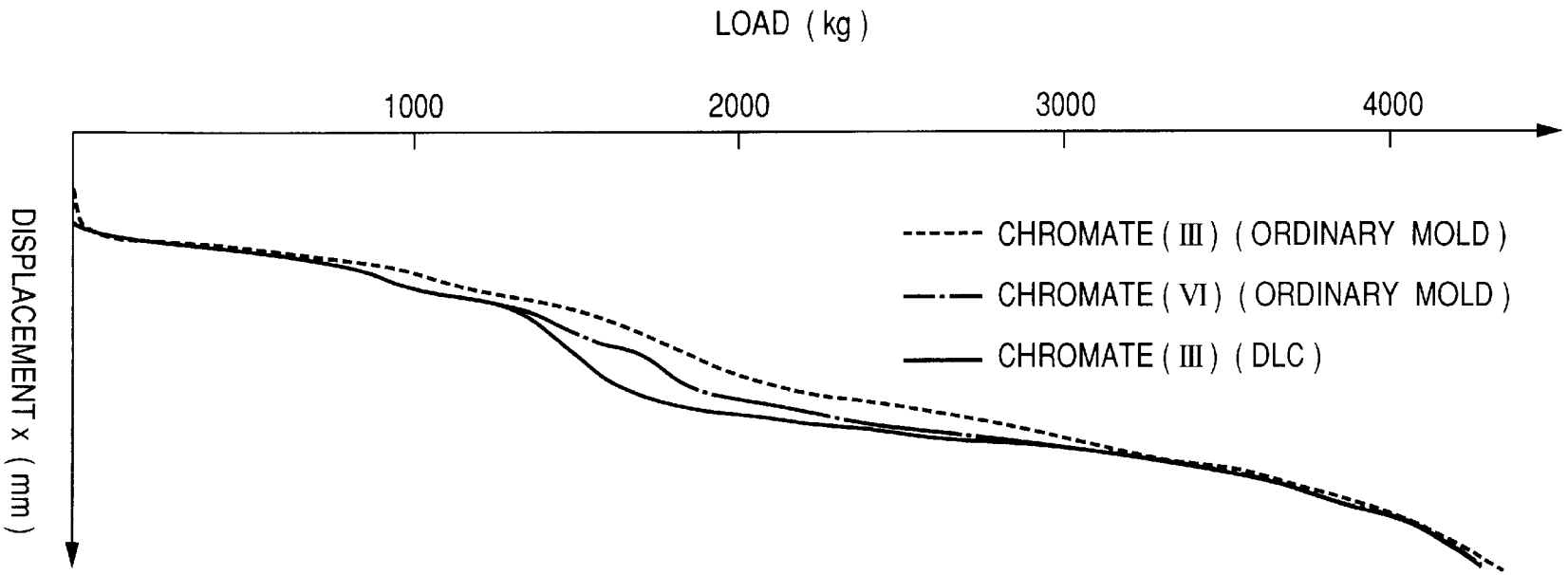
FIG. 8 is a graph showing the relation between load and displacement in caulking.

Test mode: Simple compression
Descending speed: 30 mm/min
Rising speed: 100 mm/min
Used load cell: 5 ton The chart result obtained is shown in FIG. 8. As seen from FIG. 8, there is almost no difference at the initial stage of applying the load, but there occurs some difference in the displacement x of the caulking metallic mold 111 from the load of about 1500 kgf. That is, there is more displacement by applying the same load when the chromate (III) film is made than when the chromate (VI) film is made. Further, there is more displacement at the same load when the ordinary mold is employed than when the DLC mold is employed. Namely, it is revealed that the sliding property at the time of caulking is more excellent in the chromate (VI) film than the chromate (III) film, and when employing the DLC mold than the ordinary mold.

When the metal shell is formed with the chromate (III) film or the chromate (VI) film, the ordinary mold or the DLC mold is employed to caulk the metal shell, the hexagon opposite side size N (mm) (see FIG. 6) of the tool-engaging portion 1*e* for the metal shell 1 after caulking was measured. Supposing the desired hexagon opposite side size N for the metal shell to be the same for either chromate film (N=15.7 to 16 mm), the caulking was made by applying the same load. The result is shown in Table 1. The hexagon opposite side size N (mm) indicates the average dimension when measuring a specific number of molds (ordinary mold: three, DLC mold: five) in the spark plug after caulking.

TABLE 1

| | Hexagon opposite side size (mm) | |
|---|---|---|
| Chromate film | Chromate (III) | Chromate (VI) |
| Ordinary mold | 15.99 | 15.94 |
| DLC mold | 15.9 | 15.91 |

As indicated in Table 1, the hexagon opposite side size N (mm) falls within a dimensional tolerance (15.7 to 16 mm), and is smaller when employing the DLC mold than the ordinary mold. Namely, the use of the DLC mold can keep the hexagon opposite side size from expanding, and suppress the deviation of various dimensions. When the chromate film is used on the metal shell, the hexagon opposite side size N can be suppressed. Further, when the chromate (III) film is made on the metal shell, the expansion of hexagon opposite side is suppressed in the same way as when the chromate (VI) film is made.

Example 2

In the caulking metallic mold 111 formed with the DLC film, when the caulking rounded portion depth D (mm) and the mold taper angle A(°) were changed, the dimensional deviation of the metal shell was investigated.

First of all, when it is desired to produce the spark plug satisfying the condition N≦14 mm, the caulking was performed by 50 times, employing the caulking model having the combinations of the caulking rounded portion depth D (mm) and the mold taper angle A(°) as listed in Table 2, and the standard deviation (3σ) of the hexagon opposite side size N (mm) for a group of 25 spark plugs produced was calculated. The combinations were assessed as A for the standard deviation (3σ) below 0.05, B from 0.05 to 0.1, and C from 0.1 to 0.15. The assessment result is listed in Table 2. Likewise, in the case of N=16 mm or N=20 mm, the above experiment was performed by changing the caulking rounded portion depth D (mm) and the mold taper angle A(°) as listed in Table 3 or Table 4. The obtained result is listed in Table 3 or Table 4.

TABLE 2

| Caulking rounded portion Depth D (mm) | Mold Taper angle A(°) | A/D | Evaluation |
|---|---|---|---|
| 1.5 | 15 | 10.00 | B |
| 1.5 | 35 | 23.33 | C |
| 1.6 | 14 | 8.75 | B |
| 1.6 | 16 | 10.00 | A |
| 1.6 | 34 | 21.25 | A |
| 1.6 | 36 | 22.50 | C |
| 1.7 | 15 | 8.82 | A |
| 1.7 | 35 | 20.59 | A |
| 2.3 | 15 | 6.52 | A |
| 2.3 | 35 | 15.22 | A |
| 2.4 | 14 | 5.83 | C |
| 2.4 | 16 | 6.67 | A |
| 2.4 | 34 | 14.17 | A |
| 2.4 | 36 | 15.00 | B |
| 2.5 | 15 | 6.00 | B |
| 2.5 | 35 | 14.00 | B |
| 1.9 | 30 | 15.79 | A |

TABLE 3

| Caulking rounded portion Depth D (mm) | Mold Taper angle A(°) | A/D | Evaluation |
|---|---|---|---|
| 1.7 | 15 | 8.82 | B |
| 1.7 | 35 | 20.59 | C |
| 1.8 | 14 | 7.78 | C |
| 1.8 | 16 | 8.89 | A |
| 1.8 | 34 | 18.89 | |
| 1.8 | 36 | 20.00 | C |
| 1.9 | 15 | 7.89 | B |
| 1.9 | 35 | 18.42 | A |
| 2.5 | 15 | 6.00 | B |
| 2.5 | 35 | 14.00 | A |
| 2.6 | 14 | 5.38 | C |
| 2.6 | 16 | 6.15 | A |
| 2.6 | 36 | 13.85 | B |
| 2.7 | 15 | 5.56 | B |
| 2.7 | 35 | 12.96 | B |
| 2.1 | 30 | 14.29 | A |
| 2.4 | 30 | 12.50 | A |

TABLE 4

| Caulking rounded portion Depth D (mm) | Mold Taper angle A(°) | A/D | Evaluation |
|---|---|---|---|
| 2.1 | 10 | 4.76 | B |
| 2.1 | 20 | 9.52 | C |
| 2.2 | 9 | 4.09 | B |
| 2.2 | 11 | 5.00 | A |
| 2.2 | 19 | 8.64 | A |
| 2.2 | 21 | 9.55 | C |
| 2.3 | 10 | 4.35 | A |
| 2.3 | 20 | 8.70 | A |
| 2.9 | 10 | 3.45 | B |
| 2.9 | 20 | 6.90 | A |
| 3 | 9 | 3.00 | B |
| 3 | 11 | 3.67 | A |
| 3 | 19 | 6.33 | B |
| 3 | 21 | 7.00 | B |
| 3.1 | 10 | 3.23 | B |
| 3.1 | 20 | 6.45 | B |
| 2.7 | 15 | 5.56 | A |

In the case (1) of N≦14 mm as listed in Table 2, it will be found that when the caulking metallic mold satisfying 6≦A/D≦22 (condition 1) is employed, the dimensional deviation of hexagon opposite side size N (mm) can be further suppressed. Likewise, as listed in Table 3 or Table 4, when the caulking metallic mold is employed satisfying 5.5≦A/D≦19.5 (condition 2) in the case (2) of N=1, or 3≦A/D≦9.5 (condition 3) in the case (3) of N=20, the dimensional deviation of hexagon opposite side size N (mm) can be further suppressed. Moreover, if the condition is satisfied such that 15°≦A/D≦35° and 1.6 mm≦D≦2.4 mm in the case (1), 15°≦A/D≦35° and 1.8 mm≦D≦2.6 mm in the case (2), 10°≦A/D≦20° and 2.2 mm≦D≦3 mm in the case (3), the dimensional deviation can be further reduced.

This application is based on Japanese Patent application JP 2001-131792, filed Apr. 27, 2001, the entire content of which is hereby incorporated by reference, the same as if set forth at length.

What is claimed is:

1. A method for manufacturing a spark plug, the spark plug comprises: a cylindrical metal shell having a portion to be caulked and a tool-engaging portion that is to be attached on an engine; an insulator that is inserted into the metal shell and extends axially; and a caulking metallic mold, the method comprising caulking the portion to be caulked to be fixed to an outer circumferential face of the insulator with the caulking metallic mold, wherein the caulking metallic mold comprises a face, the face comprising a hard carbon film that comprises an amorphous carbon phase, and the face is contact with or sliding to the portion to be caulked.

2. The method according to claim 1, wherein the hard carbon film has a thickness of 0.6 to 1.2 μm.

3. The method according to claim 1, wherein the face comprises: a first layer comprising one of chromium and titanium; and a second layer comprising one of silicon and germanium, and the hard carbon film is formed on the second layer.

4. The method according to claim 1, wherein the caulking metallic mold comprises the faces for one of contacting and sliding on both upper and lower surfaces, and each of the faces for one of contacting and sliding are capable of being used to the caulking process by that upper and lower surfaces are turned around.

5. The method according to claim 1, wherein the caulking metallic mold defines a through hole extending axially and has an inner circumferential face that comprises a tapering inner circumferential face and a caulking rounded portion, wherein the caulking rounded portion is used to curve the portion to be caulked, and in case that an angle made by a line orthogonally crossing a central axial line with respect to the tapering inner circumferential face in a cross section containing the central axial line is defined as a mold taper angle A(°) and the axial length of the caulking rounded portion is defined as a caulking rounded portion depth D (mm), the following condition is satisfied, the condition being, when an opposite side size of the tool-engaging portion is 14 mm or less long, $$6 \leqq A/D \leqq 22$$

when the opposite side size of the tool-engaging portion is from 15.7 to 16 mm long and a screw diameter of the metal shell as specified in JIS-B8031 is 14 mm, 12 mm or 10 mm, $$5.5 \leqq A/D \leqq 19.5$$

when the opposite side size of the tool-engaging portion is from 19.7 to 20 mm long and a screw diameter of the metal shell as specified in JIS-B8031 is 14 mm, $$3 \leqq A/D \leqq 9.5.$$

6. The method according to claim 1, wherein an outer circumferential face of the portion to be caulked is:

plated with zinc or nickel and further treated with chromate, or plated with nickel.

7. The method according to claim 2, wherein an outer circumferential face of the portion to be caulked is:

plated with zinc or nickel and further treated with chromate, or plated with nickel.

8. The method according to claim 3, wherein a chromate film having a film thickness of 0.2 to 0.5 μm and comprising chromium (III) at 95% by weight or more of chromium constituent is formed on the outer circumferential face of the portion to be caulked.

9. The method according to claim 4, wherein a chromate film having a film thickness of 0.2 to 0.5 μm and comprising chromium (III) at 95% by weight or more of chromium constituent is formed on the outer circumferential face of the portion to be caulked.

10. The method according to claim 5, wherein the chromate film comprises substantially no chromium (VI).

11. The method according to claim 6, wherein the chromate film comprises substantially no chromium (VI).

12. The method according to claim 5, wherein the chromate film is formed by dipping the portion to be caulked in a chromate treatment bath comprising a mixture of chromium (III) salt and a complexing agent for chromium (III).

13. A caulking metallic mold for a spark plug, the spark plug comprising: a cylindrical metal shell having a portion to be caulked and a tool-engaging portion that is to be attached on an engine; an insulator that is inserted into the metal shell and extends axially; and the caulking metallic mold, wherein the caulking metallic mold is used to caulk the portion to be caulked to be fixed to an outer circumferential face of the insulator, the caulking metallic mold comprises a face, the face comprising a hard carbon film that comprises an amorphous carbon phase, and the face is contact with or sliding to the portion to be caulked.

* * * * *